US006369677B1

(12) United States Patent
Gevorgian et al.

(10) Patent No.: US 6,369,677 B1
(45) Date of Patent: Apr. 9, 2002

(54) ARRANGEMENT FOR MORE EVEN CURRENT DISTRIBUTION IN A TRANSMISSION LINE

(75) Inventors: Spartak Gevorgian, Göteborg; Leif Bergstedt, Sjömarken, both of (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/383,915

(22) Filed: Aug. 26, 1999

(30) Foreign Application Priority Data

Aug. 26, 1998 (SE) ..... 9802859

(51) Int. Cl.[7] ..... H01P 3/08; H01P 7/00
(52) U.S. Cl. ..... 333/238; 333/219
(58) Field of Search ..... 333/238, 219, 333/246

(56) References Cited

U.S. PATENT DOCUMENTS 5,751,201 A * 5/1998 Pavio ..... 333/219
5,825,266 A * 10/1998 Gehrke ..... 333/219
5,834,995 A 11/1998 Richards et al.

FOREIGN PATENT DOCUMENTS

| | | |
|---|---|---|
| DE | 197 23 483 | 12/1998 |
| GB | 2 284 094 | 5/1995 |
| JP | 3-10402 | 1/1991 |
| JP | 4-368003 | 12/1992 |
| WO | 98/56061 | 12/1998 |

* cited by examiner

*Primary Examiner*—Robert Pascal
*Assistant Examiner*—Kimberly E Glenn
(74) *Attorney, Agent, or Firm*—Burns, Doane, Swecker & Mathis, L.L.P.

(57) ABSTRACT

More even current distribution in a transmission line is provided by an arrangement including a first conductive layer, a dielectric layer and a ground plane. The first conductive layer, the dielectric layer and the ground plane extend mainly in substantially the same direction, with the dielectric layer arranged between the first conductive layer and the ground plane. The arrangement includes an object located between the dielectric layer and the ground plane. The object can be electrically conductive or made of a dielectric material.

12 Claims, 5 Drawing Sheets

ARRANGEMENT FOR MORE EVEN CURRENT DISTRIBUTION IN A TRANSMISSION LINE

BACKGROUND

The present invention relates to an arrangement for more even current distribution in a transmission line. The arrangement is primarily intended for use at microwave frequencies, and its main application is within the antenna field, above all for feeding so called patch antennas.

In modem communication systems, it is of the utmost importance to reduce the weight, to keep the production cost down and to minimize the electric losses of the antennas used in the system. To this end, use is often made of what are known as patch antennas, in other words antennas which have plane radiating elements, or patches, which have their main extension in two planes.

The patches are often fed via a feed network which comprises open transmission lines arranged in association with dielectric material. The losses in these open transmission lines are due mainly to losses in the dielectric materials and to limited conductivity in the transmission lines, combined with what is known as the skin effect.

The limited conductivity in the conductors combined with what is known as the skin effect in these conductors causes the current flowing in the conductor to be distributed unevenly over the cross section of the conductor in the longitudinal direction of the conductor, the majority of the current flowing in the conductor flowing in small areas concentrated around the outer edges of the conductor. This phenomenon is called current crowding, and increases as the frequency of the current in the lines increases, which makes the phenomenon especially troublesome in the microwave range.

The known art for reducing current crowding in a conductor within the microwave range comprises arrangements in which the conductors and the dielectric material are designed with a V-shaped cross section in the longitudinal direction of the arrangement. This has the effect of reducing current crowding to a certain extent, but has a disadvantage in that mass production of arrangements of V-shaped cross section is difficult and expensive.

Another known arrangement for reducing current crowding in a conductor within the microwave range comprises a conductor with a rectangular cross section in the longitudinal direction of the arrangement, arranged on a dielectric material likewise with an essentially rectangular cross section in the longitudinal direction of the arrangement, where the dielectric material has recesses, "grooves", on both sides of the conductor. This has the effect of reducing current crowding to a certain extent, but this arrangement is also difficult and expensive to mass produce.

Japanese patent application 3010402 discloses a device for obtaining a microstrip line with small transmission losses, by means of providing a magnetic body in a position facing the conductor, with the interposition of the dielectric substrate. A drawback of this device would be that most magnetic materials are inherently lossy, which means that the introduction of a magnetic body in the device will not lower the losses as much as might be desired. In addition, magnetic materials are expensive to use, since they are not used as standard materials within the electronics industry. Thus, the device disclosed in JP 3010402 will have relatively high losses, and will be relatively expensive to produce.

SUMMARY

The object of the present invention is therefore to obtain an arrangement for an open transmission line, with low losses and even current distribution, which arrangement is simple and inexpensive to mass-produce. The arrangement according to the invention is also to be of low weight.

These objects are achieved by means of an arrangement which comprises a first conductive layer, a dielectric layer, and a ground plane, where the first conductive layer, the dielectric layer, and the ground plane have their main extent essentially in the same direction, with the dielectric layer arranged between the first conductive layer and the ground plane, further comprising an object located between the dielectric layer and the ground plane. Said object consists of a dielectric body, or of a body made of a conductive material.

The use of an object made of a dielectric material or of a conductive material allows an arrangement according to the invention to be manufactured using only materials which are standard materials in the electronics industry, thus making the arrangement easy and inexpensive to manufacture. In addition, an arrangement according to the invention will have significantly lower losses than the background art. Also, the use of an object made of a dielectric material or of a conductive material allows the object to be made simply as a protrusion of the above mentioned dielectric layer or the ground layer.

In a preferred embodiment of the invention, said object of a dielectric material connects the ground plane to the dielectric layer.

In a further preferred embodiment, said object of a conductive material is connected only to the ground plane.

These and other advantageous embodiments of the invention will be described in greater detail below.

BRIEF DESCRIPTION OF THE DRAWINGS

The invention will be described in greater detail below with the aid of examples of embodiments and with reference to the appended drawings, in which.

DETAILED DESCRIPTION

Figure 1:
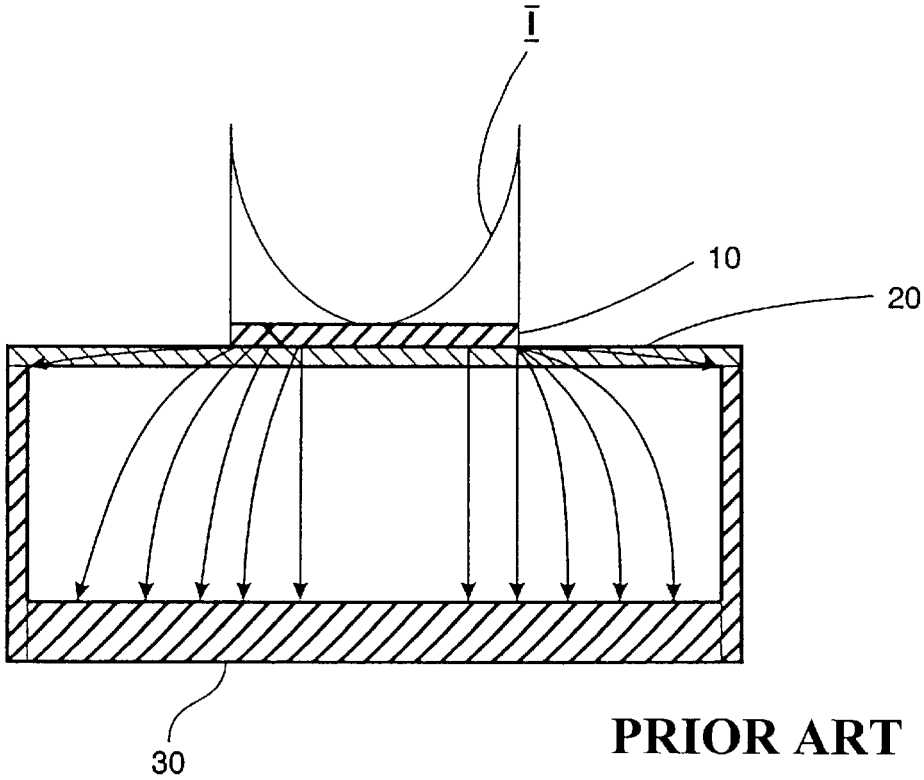
PRIOR ART Fig.1
FIG. 1 shows a cross section in the longitudinal direction of a transmission line in the conventional art, and the field and current distribution in such an arrangement.

FIG. 1 shows a cross section in the longitudinal direction of an arrangement for an open transmission line according to the conventional art what is known as a stripline arrangement. The arrangement comprises a first conductive layer 10, a dielectric layer 20 and a ground plane 30, where the first conductive layer 10, the dielectric layer 20 and the ground plane 30 have their main extent essentially in the same direction, with the dielectric layer arranged between the conductive layer and the ground plane. In the embodiment shown, the ground plane is joined to the dielectric layer. An imaginary line I shows the current distribution across the longitudinal direction of the conductor 10, and the distribution of the electric field across the longitudinal direction of the conductor 10 is shown by means of arrows.

As can be seen from FIG. 1, the electric field, and therefore also the current, are distributed extremely unevenly across the longitudinal direction of the conductor 10, which gives rise to losses. If the arrangement according to FIG. 1 is used in order to feed an antenna, the uneven current distribution will moreover reduce the gain of the antenna.

Figure 2:
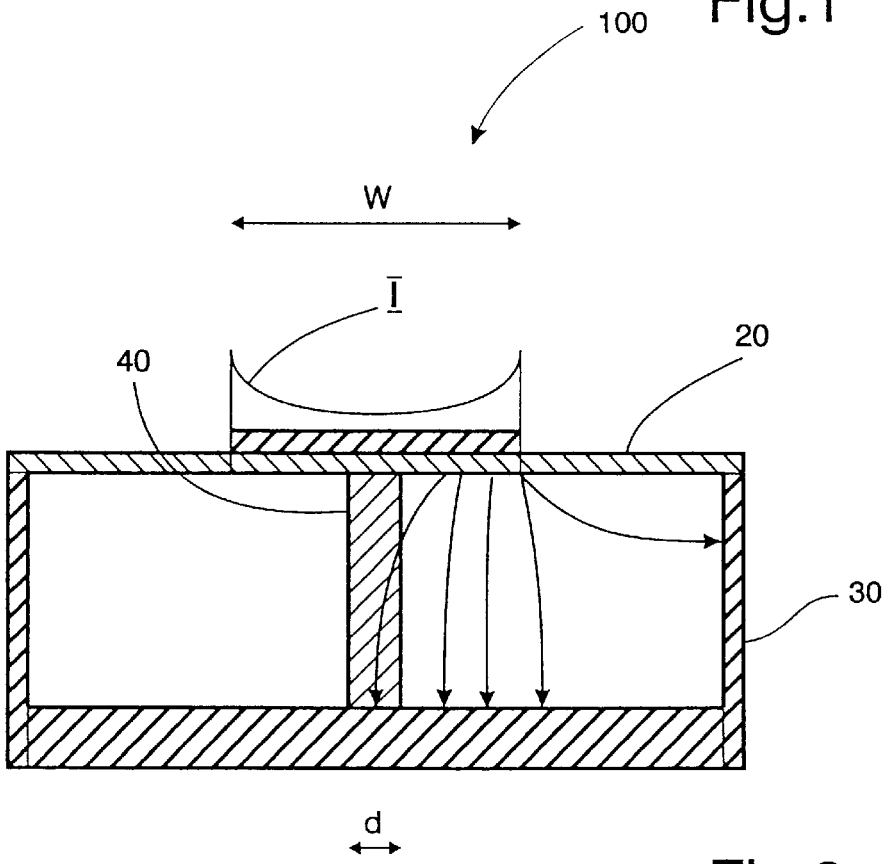
FIG. 2 shows a cross section in the longitudinal direction of a transmission line according to the invention, and the field and current distribution in such an arrangement.

FIG. 2 shows an arrangement 100 according to a preferred embodiment of the invention. As can be seen from FIG. 2, this embodiment of the invention comprises the same components as the known arrangement from FIG. 1, and moreover a body 40 which is made of a dielectric material and connects the dielectric layer 20 to the ground plane 30. The dielectric body 40 is preferably but not necessarily made of the same dielectric material as the dielectric layer 20.

It will be realized that the better the dielectric properties of the body 40 are, the better the result obtained by means of the invention will be. It Is desirable that the body 40 has losses which are as low as possible, and a dielectric constant a which is as high as possible. The dielectric body 40 suitably has a dielectric constant $\in_2$ which is greater than or equal to the corresponding constant $\in_1$ of the dielectric layer 20.

For the function of the arrangement, it is also important that the dielectric body 40 is arranged symmetrically with regard to the transverse direction of the arrangement.

On account of the dielectric properties of the body 40, the electric field and the current will be distributed differently compared with the known arrangement in FIG. 1. The respective distributions in the arrangement 100 according to the invention are shown in FIG. 2 by a corresponding imaginary line I and arrows as in FIG. 1.

In comparison with the known art, as can be seen from FIG. 2, a greater proportion of the field will go down to the ground plane 30 via the dielectric body 40 which leads to more even current distribution in the first conductor 10 compared with the known art if the arrangement 100 is used in order to feed an antenna, the more even current distribution will give the antenna higher directivity than when fed by an arrangement according to the known art.

According to the invention, the width d of the dielectric body 40 is smaller than the width w of the first conductor 10. In a preferred embodiment, the width d is dimensioned according to the formula $d<(w-6\delta)$ where $\delta$ is what is known as the skin depth of the conductor, in other words the maximum depth to which the current penetrates in the conductor.

When the arrangement 100 according to the invention is used in order to feed an antenna, the ground plane 30 of the invention can be designed without "walls", which means that the ground plane has an essentially plane shape. The fact that the ground plane is designed in this way further increases the directivity of the antenna compared with the known art and compared with the embodiment shown in FIG. 2. An embodiment 300 of the invention with a ground plane 30 without "walls" is shown in FIGS. 3*a*–3*c*.

Figure 3A:
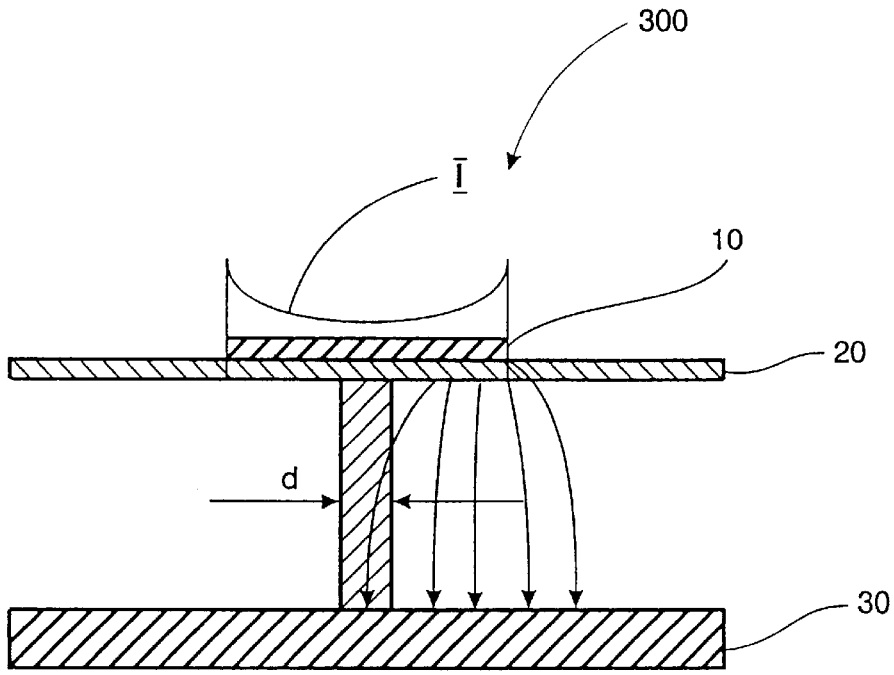
FIGS. 3–6 show cross sections in the longitudinal direction of transmission lines according to various alternative embodiments of the invention, and the field and current distribution in these arrangements.
Figure 3B:
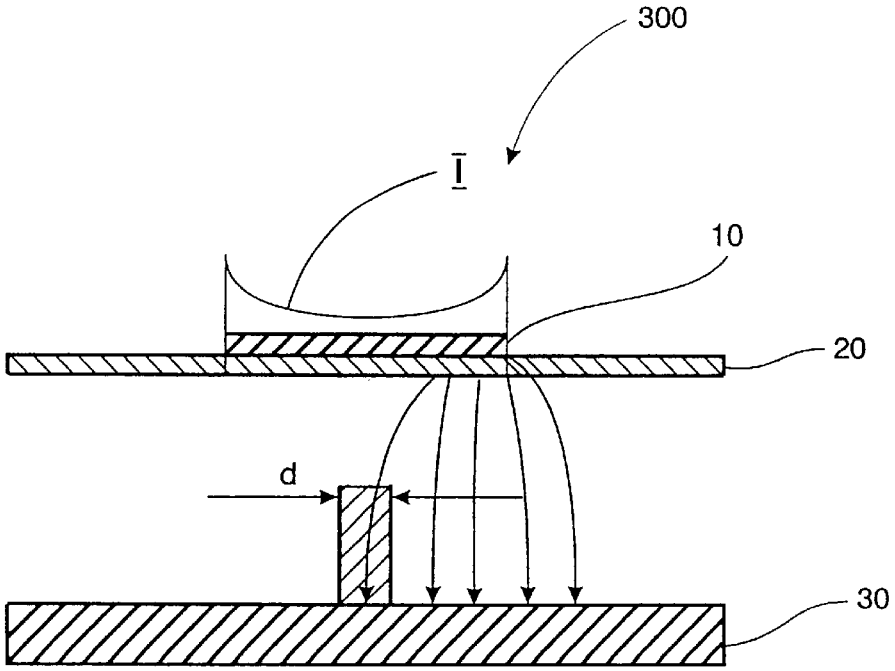
Figure 3C:
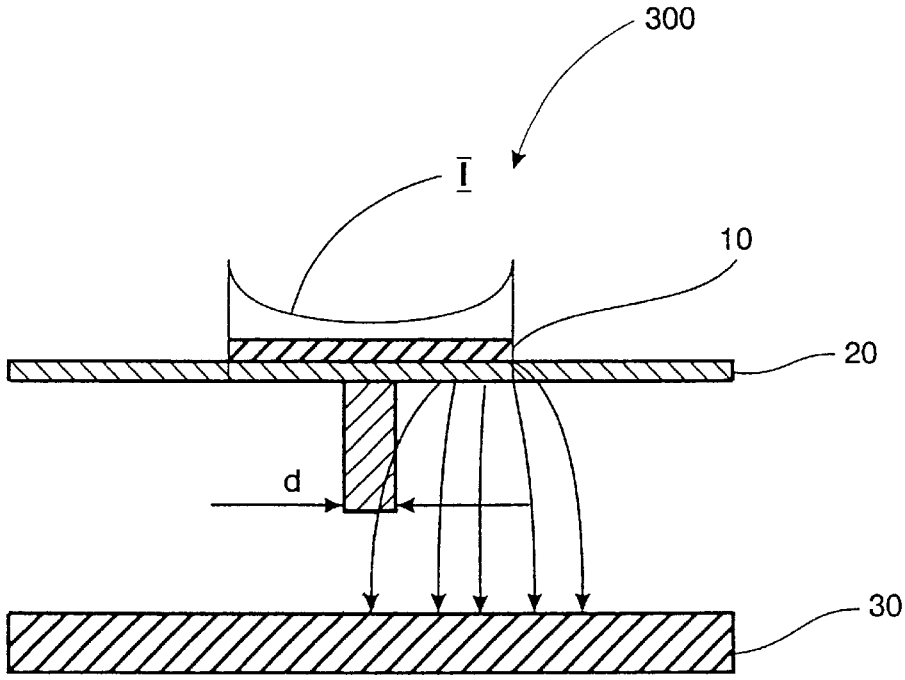

FIGS. 3*b* and 3*c* show alternative embodiments of the invention, in which the dielectric body 40 is only connected to the ground plane 30 or the dielectric layer 20 respectively.

In FIGS. 3*a*–3*c*, and in all the figures referred to in the rest of this description, the current distribution is shown by a corresponding imaginary line I as in FIGS. 1 and 2, and the field distribution is shown by arrows corresponding to those in FIGS. 1 and 2. As the meaning of the line I and the arrows is therefore considered to be known, it will not be described further.

Above, the open transmission line has been described throughout as comprising what is known as a stripline arrangement, consisting of a first conductive layer 10 located on one side of a dielectric material 20. In an alternative embodiment, which is per se not a part of the present invention, the stripline arrangement can comprise a first and a second conductive layer 10, 50, each located on one side of the dielectric layer 20, the first and the second conductive layers 10, 50 being electrically interconnected by means of connections 55.

Figure 4:
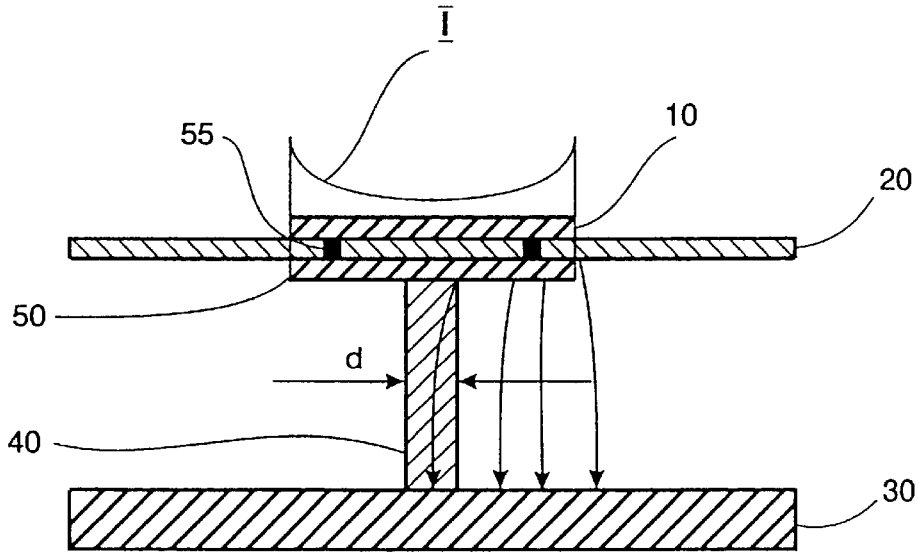

In order to illustrate the invention applied to this embodiment of a stripline arrangement, FIG. 4 shows the same embodiment of the invention as in FIG. 3*a*, but with the invention applied to this alternative embodiment of a stripline arrangement.

These two alternative embodiments of stripline arrangements will be described alternately in the drawings which are used in the continuation of this description. It is to be understood that the invention can be applied to both these embodiments of stripline arrangements.

Figure 5A:
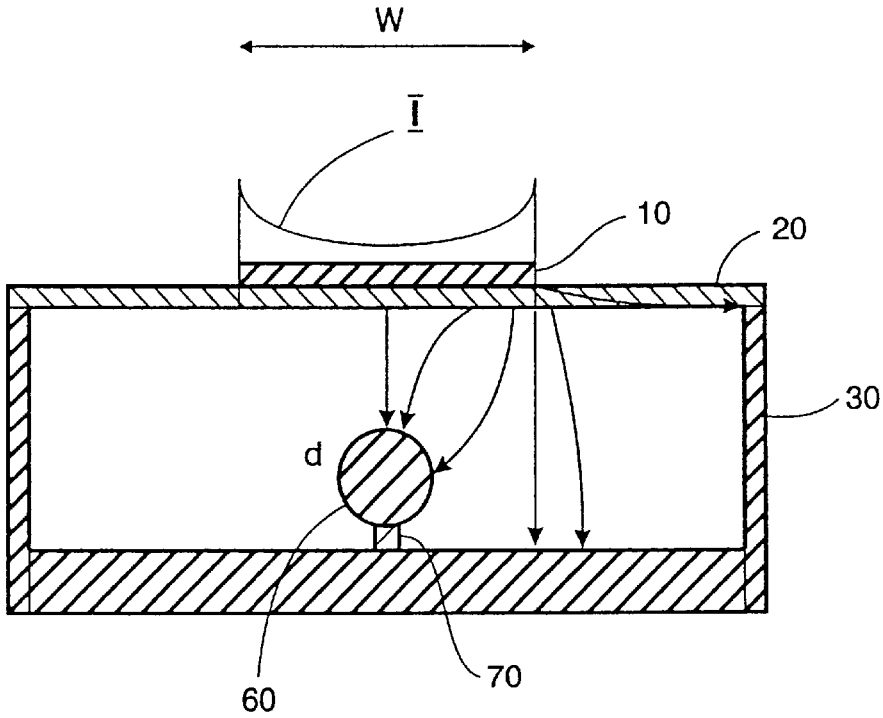
Figure 5B:
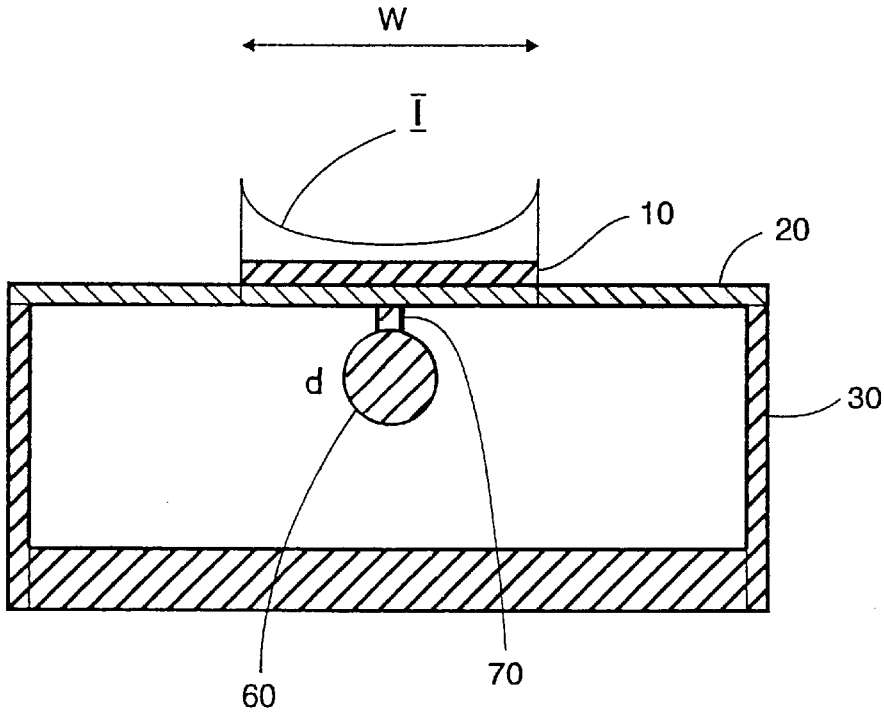

In an alternative embodiment of the invention shown in FIG. 5*a*, the dielectric body 40 described above has been replaced by a body 60 made of a conductive material. In a preferred embodiment, the body 60 made of conductive material is cylindrical, which is shown in FIG. 5*a*. The cylinder is suitably connected to the ground plane via a short connection 70. The diameter d of the cylinder is suitably smaller than the width w of the conductor. The field and current distribution in the conductor 10 can be adjusted by suitable selection of the diameter of the cylinder 60 and the distance of the cylinder from the ground plane 30 and the conductor 10. Alternatively, the body 60 of a conductive material may instead be connected to the dielectric layer 20, as shown in FIG. 5*b*.

Figure 6:
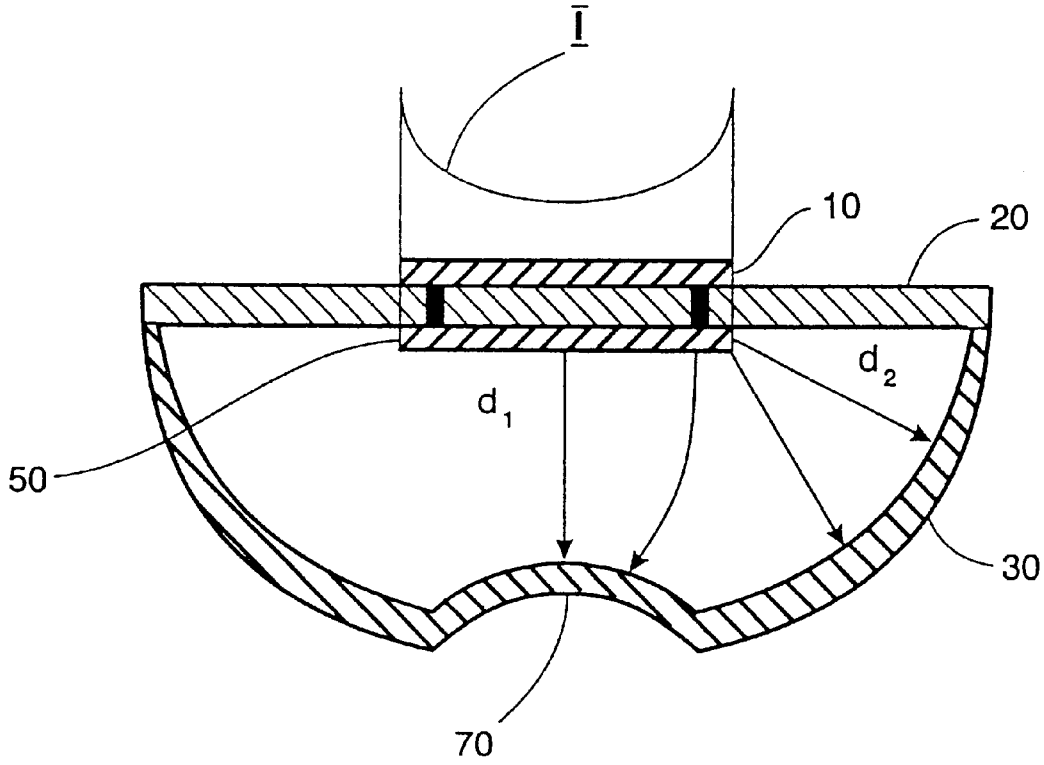

The embodiment of the invention shown In FIG. 5*a*, with a body 60 made of conductive material, can also be made in such a manner that the body 60 made of conductive material consists of a raised portion in the ground plane 30, in other words a part of the ground plane 30 is made concave in the direction of the conductor 10. This is shown in FIG. 6. The shortest distance $d_1$ from the stripline conductor to this concave part of the ground plane is suitably smaller than the shortest distance $d_2$ from the stripline conductor to other parts of the ground plane.

Above, a number of embodiments of the invention have been described. Common to the arrangements in all the embodiments is that they have an object positioned between a ground plane and a conductor or a dielectric plane. For the function of all the arrangements, it is important that the object in question is arranged symmetrically with regard to the transverse direction of the arrangement.

To have the object according to the invention consisting of a body made of a conductive material instead of a body made of a dielectric material provides good function in all the embodiments of the invention with one exception. This exception involves the embodiments in which the piece would give rise to electrical contact between the ground plane and the conductor.

The invention is not limited to the examples of embodiments described above but can be varied freely within the scope of the patent claims below. For example, the object located between the dielectric layer and the ground plane does not have to be designed as a rectangular or cylindrical body, but can have a large number of geometrical shapes while retaining its functioning. Also, it is entirely possible, and within the scope if the invention, to have a body of an conductive material connected only to the dielectric layer, or to have such a body connect the dielectric layer to the ground plane.

The invention can be applied with good function to, broadly speaking, any embodiment of stripline arrangements.

Further embodiments can comprise, for example, an object divided into two, positioned between the dielectric layer and the ground plane. In this case, one part of the body is connected to the dielectric layer of the arrangement and the other part of the body is connected to the ground plane of the arrangement.

What is claimed is:

1. An arrangement for even current distribution in a transmission line, comprising a conductive layer, a dielectric layer, and a ground plane, wherein the conductive layer, the dielectric layer, and the ground plane extend mainly in substantially the same direction, with the dielectric layer arranged between the conductive layer and the ground plane, and an object located between the dielectric layer and the ground plane, the object comprising a dielectric body, wherein the width of the dielectric body is smaller than the width of the conductive layer.

2. An arrangement for even current distribution in a transmission line, comprising a conductive layer, a dielectric layer, and a ground plane, wherein the conductive layer, the dielectric layer, and the ground plane extend mainly in substantially the same direction, with the dielectric layer arranged between the conductive layer and the ground plane, and an object located between the dielectric layer and the ground plane, the object comprising a dielectric body, wherein the width of the dielectric body is dimensioned according to the formula $d<(w-6\delta)$, where d is the width of the dielectric body, w is the width of the conductive layer and $\delta$ is the skin depth of the conductor.

3. Arrangement for even current distribution in a transmission line, comprising a first conductive layer, a dielectric layer and a ground plane, wherein the first conductive layer, the dielectric layer and the ground plane extend mainly in substantially the same direction, with the dielectric layer arranged between the first conductive layer and the ground plane, an object located between the dielectric layer and the ground plane the object comprising a body made of a conductive material.

4. Arrangement according to claim 3, wherein said body is connected to the ground plane.

5. Arrangement according to claim 3, wherein said body is connected to the dielectric layer.

6. Arrangement according to claim 3, wherein said object comprises a part of the ground plane itself, which part is concave in relation to the rest of the ground plane in the direction of the dielectric layer.

7. Arrangement according to claim 3, wherein the width of the body made of conductive material is smaller than the width of the first conductive layer.

8. Arrangement according to claim 3, further comprising a second conductive layer which extends mainly in the same direction as the first conductive layer, is located on that side of the dielectric layer which does not face towards the first conductive layer, extends parallel to the first conductive layer, and is electrically connected to the first conductive layer.

9. An arrangement for even current distribution in a transmission line, comprising a first conductive layer, a dielectric layer, and a ground plane, wherein the first conductive layer, the dielectric layer, and the ground plane extend mainly in substantially the same direction, with the dielectric layer arranged between the first conductive layer and the ground plane, and an object located between the dielectric layer and the ground plane, the object comprising a dielectric body, and a second conductive layer which extends mainly in the same direction as the first conductive layer, wherein the second conductive layer is located on that side of the dielectric layer which does not face towards the first conductive layer, extends parallel to the first conductive layer, and is electrically connected to the first conductive layer.

10. An arrangement for even current distribution in a transmission line, comprising:

a conductive layer;

a ground plane;

a dielectric layer arranged between the conductive layer and the ground plane, wherein the conductive layer, the dielectric layer, and the ground plane extend mainly in substantially the same direction; and an object formed of a dielectric material extending into the dielectric layer from at least one of the conductive layer and the ground plane.

11. The arrangement of claim 10, wherein the object extends between the conductive layer and the ground plane.

12. An arrangement for even current distribution in a transmission line, comprising:

a conductive layer;

a ground plane;

a dielectric layer arranged between the conductive layer and the ground plane, wherein the conductive layer, the dielectric layer, and the ground plane extend mainly in substantially the same direction; and an object formed of a conductive material extending into the dielectric layer from at least one of the conductive layer and the ground plane, wherein the object extends between the conductive layer and the ground plane.

* * * * *